US005602541A

United States Patent [19]

Comeau et al.

[11] Patent Number: 5,602,541

[45] **Date of Patent: *Feb. 11, 1997**

[54] SYSTEM FOR DRILLING DEVIATED BOREHOLES

[75] Inventors: Laurier E. Comeau, Ledoc; Randal H. Pustanyk, Millet, both of Canada; Nicholas P. Wallis, Barnwood, England

[73] Assignee: Baroid Technology, Inc., Houston, Tex.

[ * ] Notice: The term of this patent shall not extend beyond the expiration date of Pat. No. 5,410,303.

[21] Appl. No.: 427,602

[22] Filed: Apr. 24, 1995

Related U.S. Application Data

[63] Continuation of Ser. No. 190,719, Feb. 1, 1994, Pat. No. 5,410,303, which is a continuation of Ser. No. 879,189, May 6, 1992, abandoned, which is a continuation-in-part of Ser. No. 750,650, Aug. 27, 1991, Pat. No. 5,163,521.

[30] Foreign Application Priority Data

May 15, 1991 [GB] United Kingdom ..... 9110516

[51] Int. Cl.[6] ..... G01V 1/40

[52] U.S. Cl. ..... 340/853.3; 340/853.4; 340/853.6; 340/854.3; 340/856.1; 367/81; 367/83; 175/45; 175/61

[58] Field of Search ..... 367/25, 81, 82, 367/83; 340/853.2, 853.3, 853.4, 853.5, 853.6, 854.3, 854.4, 854.5, 854.6, 854.8, 856.1; 175/40, 45, 61

[56] References Cited

U.S. PATENT DOCUMENTS

| | | | |
|---|---|---|---|
| 4,001,773 | 1/1977 | Lamel et al. | 367/82 |
| 4,148,408 | 9/1992 | Matthews | 367/82 |
| 5,160,925 | 11/1992 | Dailey et al. | 340/853.3 |
| 5,410,303 | 4/1995 | Comeau et al. | 340/853.3 |
| 5,467,832 | 11/1995 | Orban et al. | 175/45 |

*Primary Examiner*—Ian J. Lobo
*Attorney, Agent, or Firm*—Browning Bushman

[57] ABSTRACT

Improved techniques are provided for drilling a deviated borehole through earth formations utilizing a rotary bit powered by a drill motor, and for obtaining information regarding the borehole or earth formations. A sensor permanently positioned in the drilling string between the drill bit and the drill motor detects a downhole parameter. An MWD tool may be provided within a non-magnetic portion of the drill string for receiving and transmitting a sensor representative signal to the surface. The sensor signal allows the drilling operation to be altered, and highly reliable and near-bit information thus improves the drilling operation.

32 Claims, 3 Drawing Sheets

SYSTEM FOR DRILLING DEVIATED BOREHOLES

The present invention is a continuation of U.S. Ser. No. 08/190,719, filed Feb. 1, 1994, to issue as U.S. Pat. No. 5,410,303, that is a continuation of U.S. Ser. No. 07/879, 189, filed May 6, 1992, now abandoned, that is a continuation-in-part of U.S. Ser. No. 750,650, filed Aug. 27, 1991, now U.S. Pat. No. 5,163,521.

BACKGROUND OF THE INVENTION

1. Field of the Invention

The present invention relates to the drilling of boreholes and to survey and logging techniques used to determine the path and lithology of the drilled borehole. More particularly, but not exclusively, the invention is concerned with an improved system for sensing the inclination of a borehole formed by a drill bit rotated by a downhole motor, for telemetering borehole inclination and associated logging data to the surface while drilling, and for altering the drilling trajectory in response to the telemetered data.

2. Description of the Background

Drilling operators which power a drill bit by rotating the drill string at the surface have previously measured downhole parameters with sensors located closely adjacent the drill bit, and adjusted the drilling trajectory in response to the sensed information. U.S. Pat. No. 4,324,297 discloses strain gauges located directly above the drill bit to measure the magnitude and direction of side forces on the bit. The sensed information is transmitted to the surface by an electrical line, and the bit weight and rotational speed of the drill string may be altered in response to the sensed information to vary drilling trajectory.

In recent years, drilling operators have increasingly utilized downhole motors to drill highly deviated wells. The downhole motor or "drill motor" is powered by drilling mud pressurized by pumps at the surface and transmitted to the motor through the drill string to rotate the bit. The entire drill string need not be continually rotated, which has significant advantages over the previously described technique, particularly when drilling highly deviated boreholes. A bent sub or bent housing may be used above the drill motor to achieve the angular displacement between the axis of rotation of the bit and the axis of the drill string, and thereby obtain the bend to effect curved drilling. Alternatively, the angular displacement may be obtained using a bent housing within the drill motor, by using an offset drive shaft axis for the drill motor, or by positioning a non-concentric stabilizer about the drill motor housing. As disclosed in U.S. Pat. No. 4,492,276, a relatively straight borehole may be drilled by simultaneously rotating the drill string and actuating the downhole motor, while a curved section of borehole is drilled by activating the downhole motor while the drill string above the motor is not rotated. U.S. Pat. No. 4,361, 192 discloses a borehole probe positioned within the drill pipe above a drill motor and connected to surface equipment via a wireline. The probe includes one or more accelerometers which measure orientation relative to the earth's magnetic field, and accordingly the probe is constructed of a non-ferromagnetic material. U.K. Patent 2106562 discloses a borehole probe which can be lowered on a wireline through a bore extending through a turbine of annular construction to a location between the turbine and the drill bit.

Significant improvements have occurred in measuring-while-drilling (MWD) technology, which allows downhole sensors to measure desired parameters and transmit data to the surface in real time, i.e., substantially instantaneously with the measurements. MWD mud pulse telemetry systems transmit signals from the sensor package to the surface through the drilling mud in the drill pipe. Other MWD systems, such as those disclosed in U.S. Pat. Nos. 4,320,473 and 4,562,559, utilize the drill string itself as the media for the transmitted signals. U.S. Pat. No. 4,577,701 employs an MWD system in conjunction with a downhole motor to telemeter wellbore direction information to the surface, which is then used to control rotation of the drill string and activation of the downhole motor to effect a change in the borehole direction as previously described.

A downhole MWD tool typically comprises a battery pack or turbine, a sensor package, a mud pulse transmitter, and an interface between the sensor package and transmitter. When used with a downhole motor, the MWD tool is located above the motor. The electronic components of the tool are spaced substantially from the bit and accordingly are not subject to the high vibration and centrifugal forces acting on the bit. The sensor package typically includes one or more sets of magnetometers and accelerometers for measuring the direction and inclination of the drilled borehole. The tool sensor package is placed in a non-magnetic environment by utilizing monel collars in the drill string both above and below the MWD tool. The desired length of the monel collars will typically be a function of latitude, well bore direction, and local anomalies. As a result of the monel collars and the required length of the downhole motor, the sensor package for the MWD system is typically located from ten meters to fifty meters from the drill bit.

The considerable spacing between the MWD sensor package and the drill bit has long been known to cause significant problems for the drilling operator, particularly with respect to the measurement of borehole inclination. The operator is often attempting to drill a highly deviated or substantially horizontal borehole, so that the borehole extends over a long length through the formation of interest. The formation itself may be relatively thin, e.g. only three meters thick, yet the operator is typically monitoring borehole conditions or parameters, such as inclination, thirty meters from the bit. The substantial advantage of a real time MWD system and the flexibility of a downhole motor for drilling highly deviated boreholes are thus minimized by the reality that the sensors for the MWD system are responsive to conditions spaced substantially from the bit.

It is an object of the invention to provide an improved technique for accurately monitoring borehole conditions or parameters, such as borehole inclination, while drilling a deviated borehole utilizing a downhole motor.

SUMMARY OF THE INVENTION

The present invention is defined by the appended claims to which reference should be made accordingly.

BRIEF DESCRIPTION OF THE DRAWINGS

In order that the invention may be more fully understood, reference will now be made, by way of example, to the accompanying drawings, in which.

DETAILED DESCRIPTION OF PREFERRED EMBODIMENTS

Figure 1:
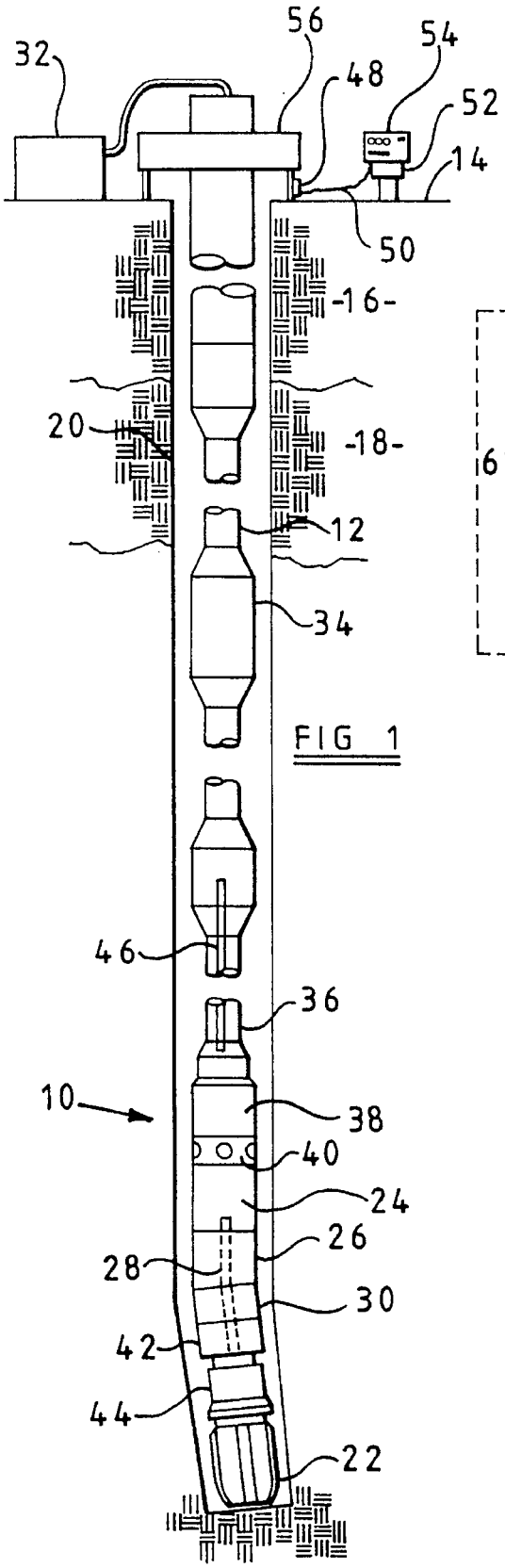
FIG. 1 is a simplified pictorial view of a drill string according to the present invention.

FIG. 1 depicts a simplified version of a system 10 for drilling a deviated borehole through earth formations while monitoring borehole characteristics or formation properties. This system includes a drill string 12 comprising lengths of conventional drill pipe extending from the surface 14 through a plurality of earth formations 16, 18. The drill string 12 is located in a borehole 20 and has at one end a rotary drill bit 22 which is powered by a fluid driven or mud motor 24. A bent sub or bent housing 26 may be provided above or below the motor 24. The motor 24 rotates a drive shaft 28, which is guided at its lower end by radial and thrust bearings (not shown) within a bearing housing 30 affixed to the housing of the mud motor. Fluid, which is commonly drilling mud, is forced by mud pumps 32 at the surface down the borehole 20 to power the motor 24. The majority of the drill string comprises lengths of metallic drill pipe, and various downhole tools 34, such as cross-over subs, stabilizer, jars, etc., may be included along the length of the drill string.

One or more non-magnetic lengths 36 of drill string, commonly referred to as monel collars, may be provided at the lower end of the drill string 12 above the drill motor 24. A conventional cross-over sub 38 preferably interconnects the lower end of a monel collar 36 with a by-pass or dump valve sub 40, and the mud motor 24 is fixedly connected directly to the sub 40. A lower bearing sub 42 is fixedly connected at the lower end of the bearing housing 30, and contains a sealed cavity with electronics, as discussed subsequently. A rotary bit sub or bit box 44 extends from the lower bearing sub 42, and is rotatable with the drill bit 22.

A significant advantage of the system 10 as shown in FIG. 1 is that the entire length of the drill string 12 need not be rotated. During straight line drilling, the drill pipe, the mud motor housing, the bearing housing, and any other housings fixed to the mud motor housing are non-rotating, and the pumps 32 power the motor 24 to rotate the shaft 28 and the bit 22. Instruments sense various downhole parameters and transmit information to an MWD (measurement-while-drilling) tool 46 located within one of the monel collars, which then transmits the information to the surface. This information may be transmitted to the surface by pressure pulses in the drilling mud in the drill string, and is received by a near surface sensor 48. The sensed information is then transmitted by lines 50 to a surface computer 52 which stores and processes the information for the drilling operator. If desired, information may be displayed in real time on a suitable medium, such as paper or a display screen 54. When the drilling operator desires to form a deviation or curve in the borehole, the mud motor 24 may remain activated while the operator rotates the rotary table 56 which then rotates the entire drill string 12. Simultaneous rotation of both the drill string and activation of the mud motor 24 causes the bit 22 to drill at an offset or deviation. During this stage of drilling, the MWD system conventionally is not transmitting data to the surface, but may still sense and briefly store data within the MWD tool 46. When the desired offset is drilled, rotation of the rotary table 56 is stopped, the drill motor 24 continues to be activated to drill the borehole at the deviated angle, and during this stage stored information may be transmitted to the surface by the MWD tool.

According to the present invention, one or more sensors located very near the drill bit 22 and below the power section of the mud motor 24 provide information to a transmitter which transmits the information to the MWD tool 46 which in turn transmits the information to the surface. The significant advantage of this arrangement is that data may be sensed very near the bit 22, rather than 20 to 100 feet up from the bit where the MWD tool is typically located. This near bit sensing allows more meaningful data to be transmitted to the surface, since the operator would like to know the characteristics of the borehole and/or the formation at a location very near the bit rather than at some location drilled hours previously.

An accelerometer or inclinometer is preferably one of the near bit sensors, since information representing the inclination of the borehole closely adjacent the bit is valuable to the drilling operator. This data cannot be easily transmitted from a near bit location to the MWD tool, however, due to the presence of the intervening mud motor 24. The necessary complexity and desirable versatility of the mud motor are not well suited to accommodate conventional data transmission lines running through the motor. It is therefore preferred that the information is transmitted from a near bit location to the MWD tool by frequency-modulated acoustic signals indicative of the sensed information. However the information my also be transmitted electromagnetically or inductively or by mud pulses, for example, and by amplitude or phase modulation or by time multiplexing rather than by frequency modulation.

Figure 2:
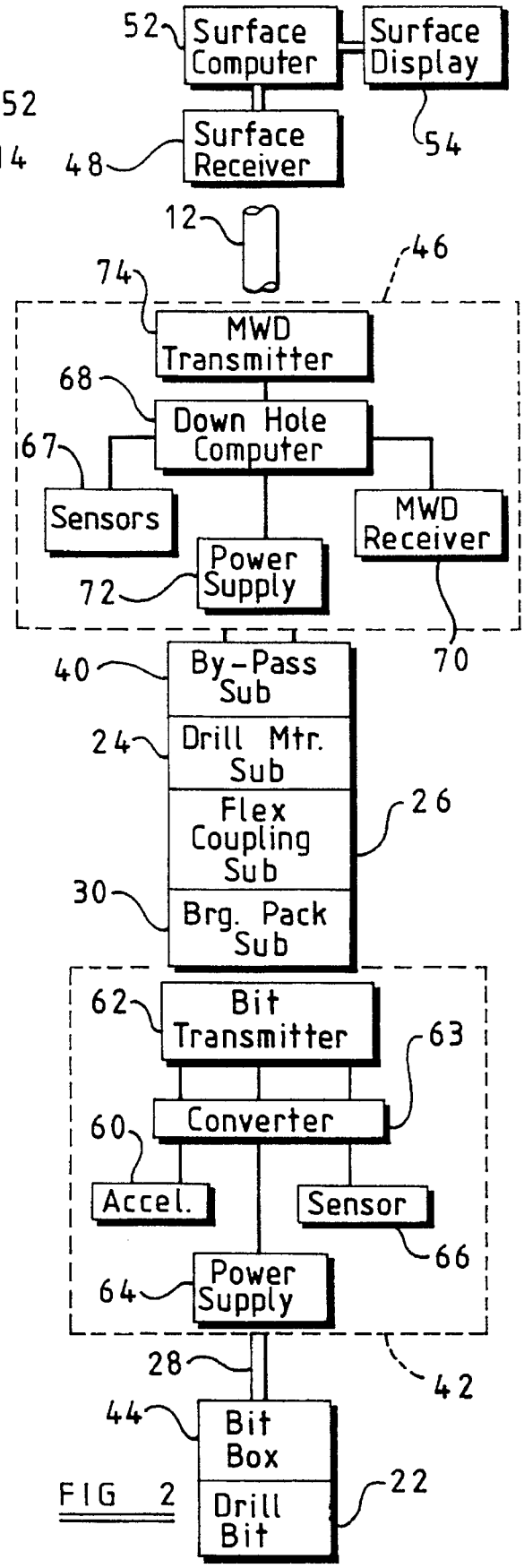
FIG. 2 is a simplified schematic diagram illustrating the components of a typical drilling and borehole surveying system according to the present invention to sense borehole trajectory and transmit sensed data to the surface for altering the drilling trajectory.

FIG. 2 generally depicts in block diagram form the primary components of the system according to the present invention, and the same numeral designations will be used for components previously discussed. The lower bearing sub 42 includes a sealed cavity which houses an accelerometer 60, a near bit acoustic transmitter 62, a power supply 64, and optionally one or more sensors 66 other than the accelerometer 60. The output signal from the or each sensor is passed to a voltage-to-frequency convertor 63 which converts sensor voltage signals to frequency signals which are in turn used to modulate acoustic signals transmitted by the transmitter 62. The signals from the transmitter 62 pass through the metal casings between the lower bearing sub 42 and an MWD receiver 70 within the monel collar 36. The transmitted signals are acoustic signals preferably having a frequency in the range of 500 to 2000 Hz. Acoustic signals may be efficiently transmitted for a distance of up to 100 feet through either the drilling mud or the metal casings. Alternatively, radio frequency signals of from 30 kHz to 3000 MHz may be used.

The MWD tool 46 includes a magnetometer or other magnetic sensor 66, a downhole data storage device or computer 68, an MWD acoustic receiver 70, a power supply 72, and an MWD mud pulse transmitter 74. Although it is generally preferred that the borehole or formation characteristics be sensed at a location below the drill motor 24, the magnetometer must be magnetically isolated from the metal housings for reasonable accuracy and reliability, and accordingly it is housed within the monel collar 36. If desired, other sensors, such as backup sensors, could also be provided within the monel collar 36, although preferably sensors other than the magnetic sensor are located at the near bit location. In addition to the inclinometer or accelerator 60, near bit sensors provided within the sub 42 may include a weight-on-bit sensor, a torque sensor, a resistivity sensor, a neutron porosity sensor, a formation density sensor, a gamma ray count sensor, and a temperature sensor. Data from each of these sensors may thus be transmitted by the transmitter 62 to the MWD receiver 70.

The computer 68 includes both temporary data storage and data processing capabilities. In particular, information from various sensors may be encoded for each sensor and arranged by the computer so that like signals will be transmitted to the surface, with the signals from each sensor being coded for a particular sensor. Porosity signals, magnetometer signals, resistivity signals, inclination signals and temperature signals may thus be intermittently transmitted to the surface by the MWD transmitter 74. The receiver 70, computer 68, transmitter 74 and any sensors within the monel collar are all powered by the power supply 72.

Figure 3:
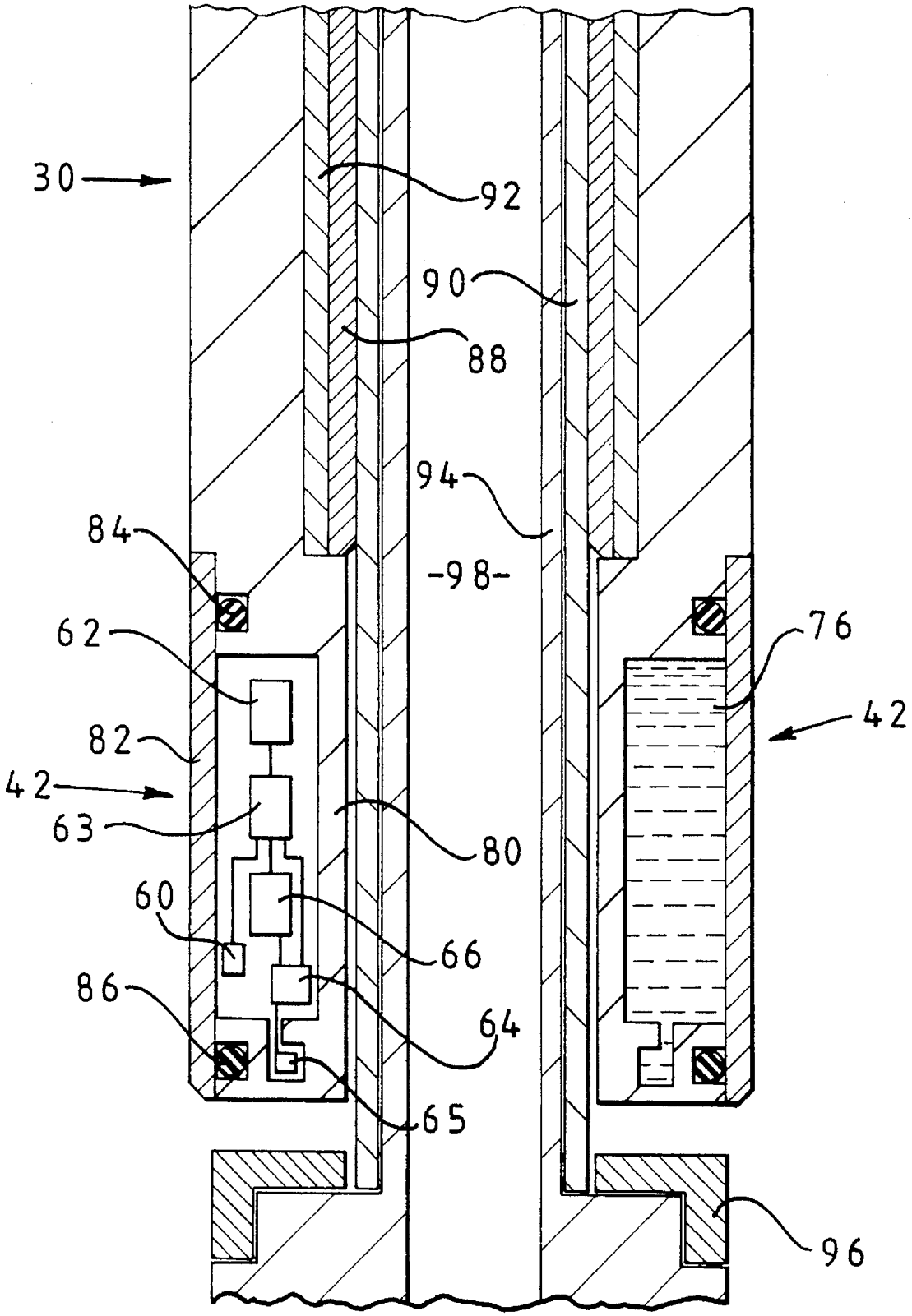
FIG. 3 is an axial section through a lower portion of a drill motor housing according to the present invention schematically showing certain components within a sealed cavity in the motor housing.

FIG. 3 shows the lower bearing sub 42 at the lower end of the bearing housing 30 which is in turn secured to the end of the bent sub or bent housing 26. The sub 42 incorporates a sealed annular cavity 76 for the near bit sensing components shown schematically in FIG. 2 within the sub 42. In non-illustrated variants of the invention the sub 42 may be part of the assembly consisting of the mud motor 24 or the bearing housing 30, and optionally may also include the bent sub or housing 26, and the sealed cavity may be formed by the sub 42 or by the housing for either the mud motor 24, the sub 26 or the housing 30. Alternatively the cavity may be formed in the drill bit itself.

The lower bearing sub 42 includes an integral recessed lower body 80 to define the cavity 76, and an outer sleeve 82 which is threadably connected to the body 80, with a fluid-tight seal being formed by O-rings 84 and 86 between radially outer portions of the body 80 and the sleeve 82. A wear sleeve 92 and a radial bearing 88 are positioned within the sub 42. The inner cylindrical surface of the radial bearing 88 is slightly less than the inner diameter of body 80, so that a sleeve extension 90 of a lower spacer sleeve normally engages the radial bearing 88 but not the body 80. The spacer sleeve and thus the extension 90 are attached to a mandrel 94, which is rotated by the drive shaft 28, so that the sleeve extension 90 and the mandrel 94 rotate with respect to the body 80. A mandrel ring 96 is attached to the mandrel 94 to secure the lower end of the sleeve extension 90 in place. The mandrel 94 defines a cylindrical full bore 98 for passing the drilling fluid to the bit, and the bit box 44 may be threadably secured directly to the lower end of the mandrel 94.

The sealed cavity 76 houses the acoustic transmitter 62, the accelerometer 60 for measuring the component (Gz) of the earth's gravitational field in the axial direction of the drill bit, the voltage-to-frequency convertor 63 and the power supply 64 which may consist of a lithium battery pack or generator assembly. Any number of additional sensors represented by 66 may be provided within the sealed cavity to monitor near bit information. If desired, a small computer may also be provided within the cavity 76 to provide temporary data storage functions. The computer may include timing programs or signal conditioning circuitry to regulate the timing for transmitting frequency modulated acoustic signals for each of the sensors from the transmitter 62 to the receiver 70. Also, a turbine or eddy current generator 65 may be provided for generating electrical power to recharge the battery pack 64 or to directly power the sensors, computer and transmitter within the cavity 76. The generator 65 is stationary with respect to the adjoining rotary mandrel 94, and accordingly my be powered by the mandrel driven by the motor 24.

Figure 4:
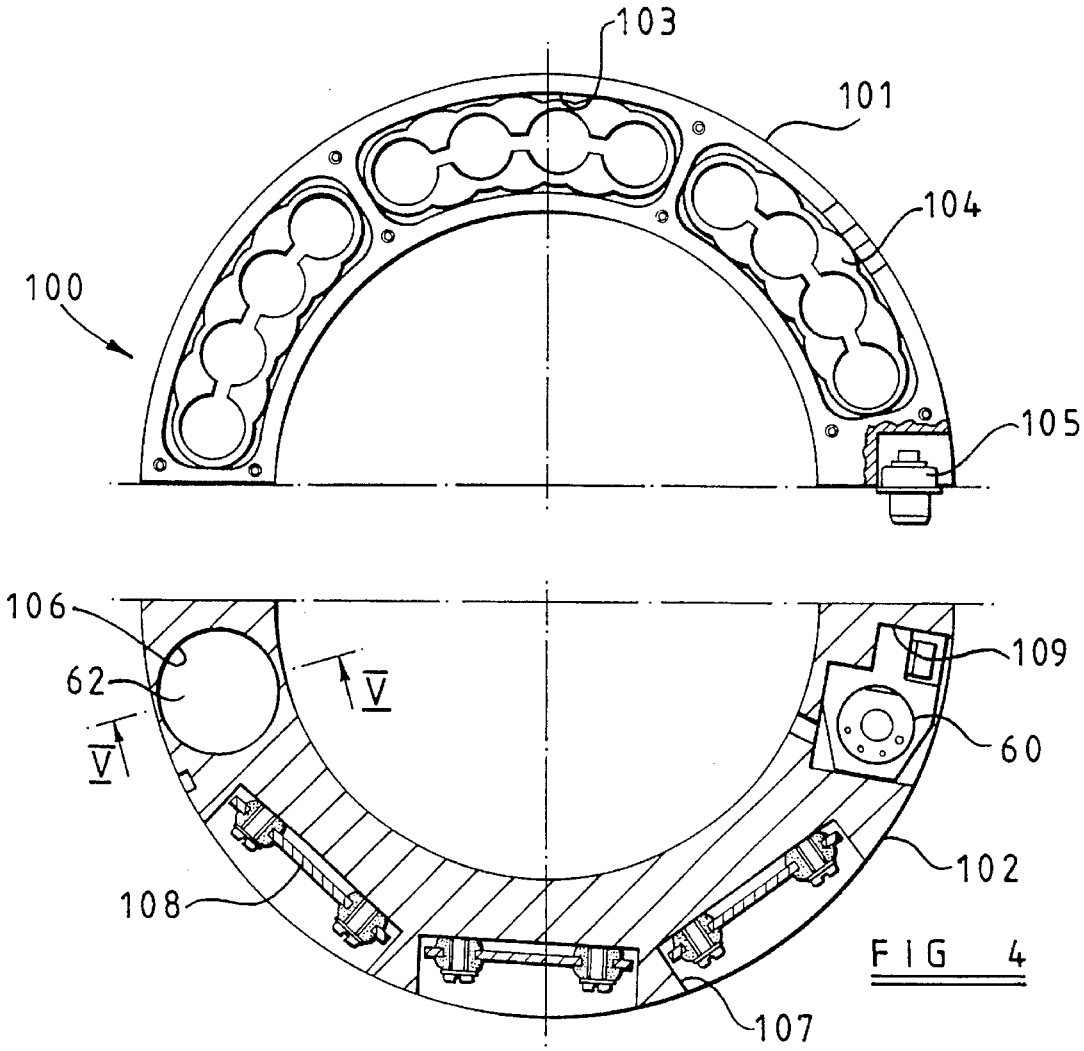
FIG. 4 is an end view of two assembly parts to be accommodated within the sealed cavity of the motor housing.

Referring to FIG. 4 the components housed within the sealed cavity 76 are located within a split cylindrical potted mould 100, shown in FIG. 4, comprising a battery mould part 101 and an electronics mould part 102 for the other components. The battery mould part 101 has three axially extending arcuate chambers 103, each of which contains a respective moulded silicone rubber sleeve 104 for accommodating four pairs of lithium batteries side-by-side. The battery mould part 101 also includes wiring (not shown) connecting the batteries to an electrical connector 105 for engaging a complementary connector (not shown) on the electronics mould part 102. The electronics mould part 102 has an axial chamber 106 for the transmitter 62, three recesses 107 for circuit boards 108 of control circuitry and an axial chamber 109 for the accelerometer 60. Although not visible in FIG. 4, the electronics mould part 102 also has a recess for a tensioning device which tensions a retaining strap for extending around the two mould parts 101 and 102 to retain the mould parts in position within the cavity 76. The control circuitry includes an analogue control circuit for the accelerometer 60, a signal conditioning circuit for encoding the sensor data for transmission, and a timing circuit for enabling the transmitter to be powered on after a preset delay. In addition circuitry may be provided for actuating the transmitter only after drilling has stopped, either in response to an acoustic pickup which senses that drilling noise has stopped or in response to an acoustic signal from the MWD receiver 70 sensed by a piezoelectric receiving device. In addition the battery mould part 101 has detachable upper and lower covers (not shown).

Figure 5:
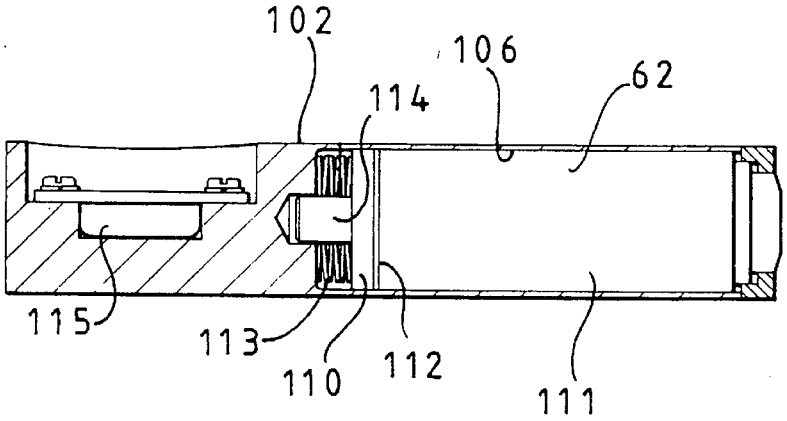
FIG. 5 is an axial section through an acoustic transmitter of one of the assembly parts.

Referring to FIG. 5, which shows a section through the electronics mould part 102 taken along the line V—V in FIG. 4, the acoustic transmitter 62 comprises two coaxial cylindrical pole pieces 110 and 111 separated by an annular air gap 112 and interconnected by an axial rod (not shown) made of magnetostrictive material. The axial rod is surrounded by a cylindrical coil within the pole piece 111, and the supply of a suitable input signal to the coil results in physical deformation of the rod in such a manner as to produce an acoustic output signal. The air gap 112 is provided to allow the rod to extend and contract without constraint, and a prestress system including a compression string 113 surrounding a stud 114 serves to compress the pole pieces 110 and 111 in the axial direction.

Those skilled in the art should now appreciate the numerous advantages of the system according to the present invention. A fast, accurate, and low cost technique is provided for reliably obtaining and transmitting valuable near bit information past the drilling motor and to the surface. In particular, well bore inclination may be monitored at a near bit position, although well bore direction may be reliably sensed and transmitted to the surface from a position above the drill motor. Complex and unreliable hard-wiring techniques are not required to pass the information by the drill motor. Although reliable near bit information is obtained, the sensors are not normally rotated during ongoing drilling operations, so that the sensors and electrical components within the sealed cavity 76 are not subject to centrifugal forces caused by drill bit rotation in the 50 to 6000 RPM range. Also, if required, data may be transmitted to the surface during the drilling mode, thereby saving valuable drilling time. Moreover, the sub 42 is substantially isolated from the high vibrational forces acting on the drill bit due to the various bearing assemblies within the bearing housing 30. The angular or orientational position of the sensors within the sealed cavity 76 is fixed, and thus the position of any sensor with respect to the sub 42 and thus the drill string 12 may be determined and recorded.

We claim:

1. A method of signalling within a borehole having therein a drill string with a drill bit at a lower end thereof, a downhole drilling motor being positioned within said drill string, said downhole drilling motor having a power assembly operable for rotating said drill bit, said method comprising:

rotating said drill bit with said downhole drilling motor at a bit rotation speed in revolutions per minute with respect to said borehole;

supporting at least one sensor at a location below said power assembly of said downhole drilling motor such that said at least one sensor does not rotate at said bit rotation speed; and detecting a downhole parameter with said at least one sensor.

2. The method of claim 1, further comprising:

relaying a signal representative of said detected downhole parameter from a position below said power assembly of said downhole drilling motor to a position above said power assembly of said downhole drilling motor.

3. The method of claim 1, wherein said step of supporting said at least one sensor further comprises:

supporting said at least one sensor such that said at least one sensor moves axially substantially in concert with said drill bit.

4. The method of claim 1, further comprising:

relaying a signal representative of said detected downhole parameter from a lower downhole position above said power assembly of said downhole drilling motor to a surface location.

5. The method of claim 1, further comprising:

supporting a first downhole transmitter at a location below said power assembly of said downhole drilling motor.

6. The method of claim 5, wherein said step of supporting said first downhole transmitter further comprises:

supporting said first downhole transmitter such that said first downhole transmitter does not rotate at said bit rotation speed.

7. The method of claim 5, further comprising:

transmitting said signal representative of said detected downhole parameter from said first transmitter to a second transmitter at a position above said power assembly of said downhole drilling motor.

8. The method of claim 1, wherein said step of supporting further comprises:

affixing said at least one sensor to a housing of said downhole drilling motor.

9. Apparatus for signalling within a borehole having therein a drill string with a drill bit at a lower end thereof, said drill bit being powered by a downhole drilling motor within said drill string, said downhole motor including a power assembly for rotating said drill bit, said apparatus comprising:

one or more sensors mounted below said power assembly of said downhole motor such that said one or more sensors are rotationally uncoupled with respect to said drill bit so as to be rotationally independent of said drill bit;

a first downhole signal transmitter positioned below said power assembly of said downhole motor for relaying signals representative of one or more parameters detected by said one or more sensors;

a second downhole signal transmitter positioned above said power assembly of said downhole motor for relaying said signals representative of said one or more parameters detected by said one or more sensors to a surface location; and at least one receiver positioned at said surface location for receiving said signals representative of said one or more parameters detected by said one or more sensors.

10. The apparatus of claim 9, further comprising:

a shaft rotatably secured to said bit for rotating said bit;

said one or more sensors being mounted so as to be axially moveable substantially in concert with said shaft and said bit.

11. The apparatus of claim 9, further comprising:

a housing annularly disposed with respect to said shaft, said one or more sensors being affixed to said housing.

12. The apparatus of claim 11, wherein:

said first downhole signal transmitter is affixed to said housing.

13. A method of signalling within a borehole having therein a drill string with a drill bit at a lower end thereof, said drill bit being powered by a downhole drilling motor within said drill string, said downhole drilling motor including a power assembly, said method comprising:

rotating said drill bit with said downhole drilling motor at a bit rotation speed in revolutions per minute with respect to said borehole;

supporting at least one signal transmitter at a location below said power assembly of said downhole drilling motor such that said at least one signal transmitter does not rotate at said bit rotation speed;

detecting a downhole parameter with at least one sensor; and transmitting a signal representative of said detected downhole parameter with said at least one signal transmitter.

14. The method of claim 13, wherein said step of supporting said at least one signal transmitter further comprises:

supporting said at least one signal transmitter such that said at least one signal transmitter moves axially substantially in concert with said drill bit.

15. The method of claim 13, further comprising:

relaying said signal representative of said detected downhole parameter from a lower downhole position above said power assembly of said downhole drilling motor to a surface location.

16. The method of claim 13, wherein said step of transmitting further comprises:

transmitting from a position below said power assembly of said downhole drilling motor to a position above said power assembly of said downhole drilling motor.

17. The method of claim 13, wherein said step of supporting further comprises:

supporting said at least one sensor such that it does not rotate at said bit rotation speed.

18. The method of claim 13, further comprising:

transmitting said signal representative of said detected downhole parameter from said at least one signal transmitter to a second signal transmitter at a position above said power assembly of said downhole drilling motor.

19. The method of claim 13, wherein said step of supporting further comprises:

affixing said at least one signal transmitter to a housing of said downhole drilling motor.

20. Apparatus for signalling within a borehole having therein a drill string with a drill bit at a lower end thereof, said drill bit being powered by a downhole drilling motor within said drill string, said downhole motor including a power assembly for rotating said drill bit, said apparatus comprising:

one or more sensors positioned below said power assembly of said downhole motor for detecting one or more parameters;

a first downhole transmitter mounted below said power assembly of said downhole motor such that said first downhole transmitter is rotationally uncoupled with respect to said drill bit so as to be rotationally independent of said drill bit, said first downhole transmitter relaying a signal representative of said one or more parameters detected by said one or more sensors; and at least one receiver positioned at a surface location for receiving said signal representative of said one or more parameters detected by said one or more sensors.

21. The apparatus of claim 20, further comprising:

a shaft portion of said drill string rotatably secured to said bit for rotating said bit; and said first downhole transmitter being axially coupled with respect to said shaft portion so as to be substantially axially moveable with said shaft portion and said bit.

22. The apparatus of claim 21, further comprising:

an annular housing in surrounding relationship to said shaft portion, said first downhole transmitter being affixed to said annular housing.

23. The apparatus of claim 22, wherein:

said one or more sensors are affixed to said annular housing.

24. Apparatus for signalling within a borehole having therein a drill string, said drill bit being powered by a downhole drilling motor within said drill string, at least a portion of said drill string forming a drive shaft rotatable by said downhole drilling motor, said drive shaft being secured to a drill bit at one end thereof and being rotatable by said downhole drilling motor adjacent a second end thereof to thereby rotate said drill bit in response to rotation of said drive shaft, said apparatus comprising:

a sensor support member mounted at a location below said second end of said drive shaft and being rotatably recoupled with respect to said drive shaft such that said sensor support member is rotatably independent of said drive shaft;

one or more sensors carried by said sensor support member for detecting one or more downhole parameters; and a signal transmission system for relaying signals representative of said one or more downhole parameters to a location in said drill string uphole with respect to said drive shaft.

25. The apparatus of claim 24, wherein:

said sensor support member is mounted radially outwardly with respect to said drive shaft.

26. The apparatus of claim 24, further comprising:

a motor housing in surrounding relationship to said drive shaft, said sensor support member being rotatably secured with respect to said motor housing.

27. The apparatus of claim 24, further comprising:

a signal transmitter mounted at a position below said second end of said drive shaft for transmission of a signal representative of said one or more downhole parameters.

28. The apparatus of claim 24, further comprising:

a motor housing in surrounding relationship to said drive shaft, said signal transmitter being rotatably secured with respect to said motor housing.

29. A method of signalling within a borehole having a drill string therein, at least a portion of said drill string forming a drive shaft with said drive shaft being rotatable by a drive unit, said drive shaft being attached to a drill bit at a first end of said drive shaft and being driven by said drive unit adjacent a second end thereof, said drill bit rotating in response to rotation of said drive shaft, said method comprising said following steps:

rotating said drive shaft with said drive unit to thereby rotate said drill bit at a drill bit rotation speed in revolutions per minute with respect to said borehole;

supporting at least one sensor at a location below said second end of said drive shaft such that said at least one sensor does not rotate at said drill bit rotation speed;

supporting a downhole signal transmitter at a location below said second end of said drive shaft; and sensing at least one parameter with said at least one sensor.

30. The method of claim 29, further comprising:

transmitting a signal representative of said at least one parameter with said downhole signal transmitter.

31. The method of claim 29, further comprising:

relaying a signal representative of said at least one parameter from a position below said top end of said drive shaft to a surface position.

32. The method of claim 29, wherein said step of rotating further comprises:

pumping fluid through said drill string to activate said drive unit for rotation of said drive shaft.

* * * * *

UNITED STATES PATENT AND TRADEMARK OFFICE

CERTIFICATE OF CORRECTION

PATENT NO. : 5,602,541

DATED : February 11, 1997

INVENTOR(S) : Laurier E. Comeau, et. al.

It is certified that error appears in the above-indentified patent and that said Letters Patent is hereby corrected as shown below:

Title page, under item [30] should be inserted to read --.
Aug. 27,1990 .....[CA] Canada.....2,024,061

Signed and Sealed this

Tenth Day of June, 1997

*Attest:*

*Attesting Officer*

BRUCE LEHMAN

*Commissioner of Patents and Trademarks*